US012264838B2

(12) United States Patent
Furuya et al.

(10) Patent No.: US 12,264,838 B2
(45) Date of Patent: Apr. 1, 2025

(54) AIR-CONDITIONING APPARATUS

(71) Applicant: Mitsubishi Electric Corporation, Tokyo (JP)

(72) Inventors: Koji Furuya, Tokyo (JP); Naofumi Takenaka, Tokyo (JP); Yuji Motomura, Tokyo (JP); Hiroki Washiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 315 days.

(21) Appl. No.: 18/003,536

(22) PCT Filed: Sep. 7, 2020

(86) PCT No.: PCT/JP2020/033759
§ 371 (c)(1),
(2) Date: Dec. 28, 2022

(87) PCT Pub. No.: WO2022/049763
PCT Pub. Date: Mar. 10, 2022

(65) Prior Publication Data

US 2023/0250992 A1 Aug. 10, 2023

(51) Int. Cl.
*F24F 11/85* (2018.01)
*F24F 1/0068* (2019.01)

(52) U.S. Cl.
CPC ..... *F24F 11/85* (2018.01); *F24F 1/0068* (2019.02)

(58) Field of Classification Search
CPC ..... F24F 11/85; F24F 1/0068; F24F 11/84
See application file for complete search history.

(56) References Cited

U.S. PATENT DOCUMENTS 10,054,337 B2 * 8/2018 Yamashita ..... F25B 7/00
2012/0118005 A1 5/2012 Yamashita et al.
2015/0176864 A1 6/2015 Yamashita et al.

FOREIGN PATENT DOCUMENTS

JP 5188629 B2 4/2013
WO 2011/030430 A1 3/2011

OTHER PUBLICATIONS

International Search Report of the International Searching Authority mailed Nov. 10, 2020 in corresponding International Application No. PCT/JP2020/033759 (and English translation).

* cited by examiner

*Primary Examiner* — Henry T Crenshaw
(74) *Attorney, Agent, or Firm* — Posz Law Group, PLC

(57) ABSTRACT

An air-conditioning apparatus includes an outdoor unit, multiple indoor units, and an intermediate unit. The indoor units each include a flow control device and an indoor controller. The intermediate unit includes an intermediate heat exchanger, a circulation device, and an intermediate controller. When at least one indoor unit starts operating, the intermediate controller determines whether a flow rate of a heat medium flowing into the intermediate heat exchanger is greater than or equal to a minimum flow rate. In response to determining that the flow rate is less than the minimum flow rate, the intermediate controller transmits an open instruction signal, representing an instruction to increase the opening degree of the flow control device, to the indoor controller of the indoor unit that is in a non-operation state. The indoor controller increases the opening degree of the flow control device in response to the received open instruction signal.

15 Claims, 3 Drawing Sheets

AIR-CONDITIONING APPARATUS

CROSS REFERENCE TO RELATED APPLICATION

This application is a U.S. national stage application of PCT/JP2020/033759 filed on Sep. 7, 2020, the contents of which are incorporated herein by reference.

TECHNICAL FIELD

The present disclosure relates to an air-conditioning apparatus that conditions air using refrigerant and a heat medium.

BACKGROUND ART

A known air-conditioning apparatus includes a refrigerant circuit through which refrigerant is circulated and a heat medium circuit through which a heat medium; such as water or brine, is circulated (refer to Patent Literature 1, for example). The refrigerant circuit includes an outdoor unit, serving as a heat source side. The heat medium circuit includes an indoor unit, serving as a load side. The refrigerant exchanges heat with the heat medium in an intermediate unit located in the refrigerant circuit and the heat medium circuit. The heat medium cooled or heated by the refrigerant exchanges heat with air in the indoor unit, thereby conditioning the air in a room.

Most heat medium circuits include pumps to pressurize the heat medium. Such pumps that are often selected and installed include a pump capable of compensating for pressure loss caused by deposition of scale and a pump capable of dealing with a variation in thermal load caused by, for example, an increase in the number of indoor units.

CITATION LIST

Patent Literature

Patent Literature 1: Japanese Patent No. 5188629

SUMMARY OF INVENTION

Technical Problem

However, for example, a small thermal load or a small number of indoor units in operation leads to a smaller number of heat medium passages, which may increase pressure loss. Thus, the heat medium may fail to be supplied at a sufficient flow rate to a heat exchanger included in the intermediate unit.

If a sufficient flow rate of the heat medium to the intermediate unit is not achieved in a cooling operation, the cooling capacity of the heat source side may cause freezing of the heat medium in the heat exchanger of the intermediate unit.

The present disclosure has been made in response to the above issue, and an object of the present disclosure is to provide an air-conditioning apparatus that reduces pressure loss of a heat medium to inhibit freezing of the heat medium in a heat exchanger of an intermediate unit.

Solution to Problem

An air-conditioning apparatus according to an embodiment of the present disclosure includes a refrigerant circuit through which refrigerant circulates, a heat medium circuit through which a heat medium circulates, an outdoor unit located in the refrigerant circuit and configured to exchange heat between the refrigerant and outdoor air, a plurality of indoor units located in the heat medium circuit and configured to exchange heat between the heat medium and indoor air to condition the indoor air, and an intermediate unit located in the refrigerant circuit and the heat medium circuit and configured to exchange heat between the refrigerant and the heat medium and send the heat medium subjected to heat exchange with the refrigerant to the plurality of indoor units. Each of the plurality of indoor units includes a flow control device configured to regulate a flow rate of the heat medium leaving a corresponding one of the plurality of indoor units, and an indoor controller configured to adjust an opening degree of the flow control device. The intermediate unit includes an intermediate heat exchanger configured to exchange heat between the refrigerant and the heat medium, a circulation device configured to circulate the heat medium between the intermediate heat exchanger and each of the plurality of indoor units, and an intermediate controller configured to control the circulation device. The intermediate controller is configured to, when at least one of the plurality of indoor units starts operating, determine whether a flow rate of the heat medium flowing into the intermediate heat exchanger from the plurality of indoor units is greater than or equal to a predetermined minimum flow rate, and in response to determining that the flow rate is less than the minimum flow rate, transmit an open instruction signal to the indoor controller of the indoor unit that is in a non-operation state of the plurality of indoor units, the open instruction signal representing an instruction to increase the opening degree of the flow control device. The indoor controller is configured to, when receiving the open instruction signal, increase the opening degree of the flow control device in response to the open instruction signal.

Advantageous Effects of Invention

In the air-conditioning apparatus according to the embodiment of the present disclosure, the intermediate controller determines whether the flow rate of the heat medium flowing into the intermediate heat exchanger is greater than or equal to the minimum flow rate. In response to determining that the flow rate of the heat medium flowing into the intermediate heat exchanger is less than the minimum flow rate, the intermediate controller transmits the open instruction signal, representing an instruction to increase the opening degree, to the indoor controller of the indoor unit in the non-operation state. In response to receiving the open instruction signal, the indoor controller increases the opening degree of the flow control device. This results in a reduction in pressure loss in the heat medium circuit, leading to an increase in flow rate of the heat medium flowing into the intermediate heat exchanger. Thus, the air-conditioning apparatus 100 can inhibit freezing of the heat medium in the intermediate heat exchanger 50.

DESCRIPTION OF EMBODIMENTS

An air-conditioning apparatus 100 according to Embodiment will be described in detail below with reference to the drawings. Note that the relationship between the sizes of components in the following figures may differ from that of actual ones.

Embodiment

Figure 1:
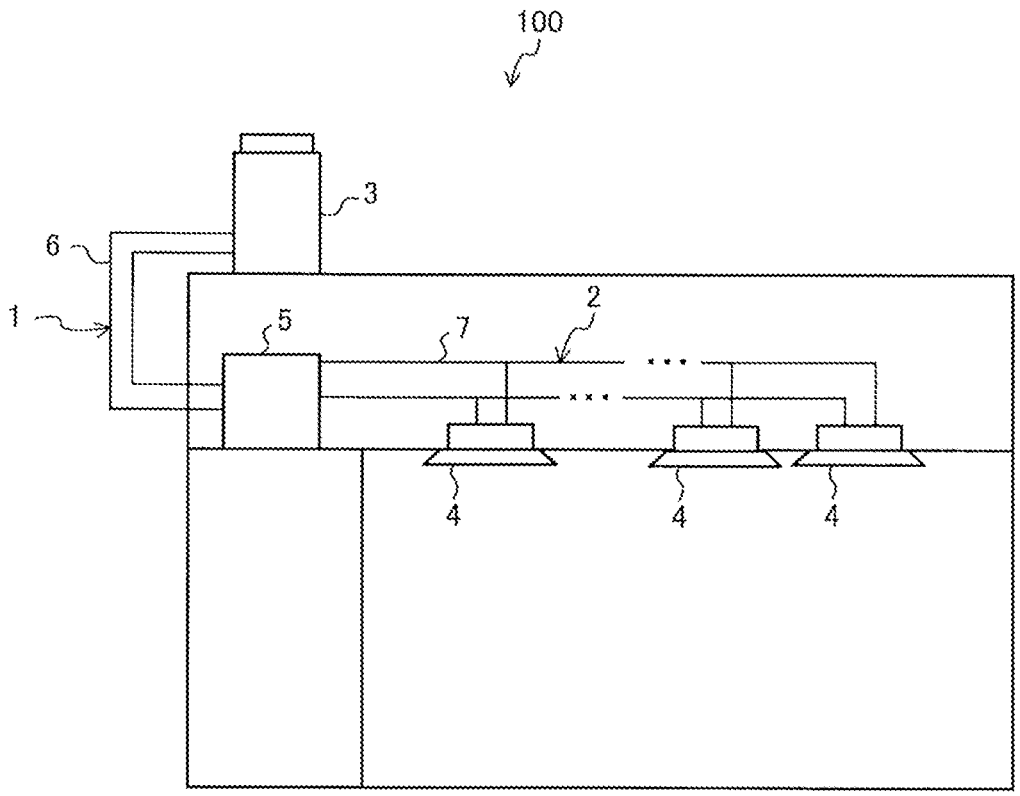
FIG. 1 is a schematic diagram illustrating exemplary installation of an air-conditioning apparatus according to Embodiment.

FIG. 1 is a schematic diagram illustrating exemplary installation of the air-conditioning apparatus according to Embodiment. The air-conditioning apparatus 100 includes a refrigerant circuit 1 and a heat medium circuit 2. An outdoor unit 3 is located in the refrigerant circuit 1, Multiple indoor units 4 are located in the heat medium circuit 2. An intermediate unit 5 is located in the refrigerant circuit 1 and the heat medium circuit 2. The outdoor unit 3 is connected to the intermediate unit 5 by a refrigerant pipe 6. The intermediate unit 5 is connected to each of the multiple indoor units 4 by a heat medium pipe 7.

Although Embodiment describes a case where the air-conditioning apparatus 100 includes one intermediate unit 5, the air-conditioning apparatus 100 may include multiple intermediate units 5. In this case, the outdoor unit 3 is connected to each of the intermediate units 5 by the refrigerant pipe 6. Each intermediate unit 5 is connected to each of one or more indoor units 4.

Refrigerant circulates through the refrigerant circuit 1. Examples of the refrigerant include a single refrigerant, such as R22 or R134a, a near-azeotropic refrigerant mixture, such as R410A or R404A, and a non-azeotropic refrigerant mixture, such as R4070. The refrigerant may be a refrigerant having a relatively low global warming potential, such as R1234yf, which contains a double bond in its chemical formula, a mixture containing the refrigerant, or a natural refrigerant, such as $CO_2$ or propane. The refrigerant is cooled or heated in the outdoor unit 3.

A heat medium circulates through the heat medium circuit 2. Examples of the heat medium, which does not change its form within a use temperature range, include brine, water, a liquid mixture of brine and water, and a liquid mixture of water and a highly anticorrosive additive.

In the intermediate unit 5, the heat medium exchanges heat with the refrigerant cooled or heated in the outdoor unit 3, After exchanging heat with the refrigerant, the heat medium exchanges heat with air in a room, serving as an air-conditioning target space, in the indoor units 4. Thus, the air in the room is conditioned. In this case, the outdoor unit 3, which generates heat, functions as a heat source unit. The refrigerant circuit 1, through which the refrigerant to supply the heat to the heat medium via the intermediate unit 5 is circulated, functions as a heat source system.

Figure 2:
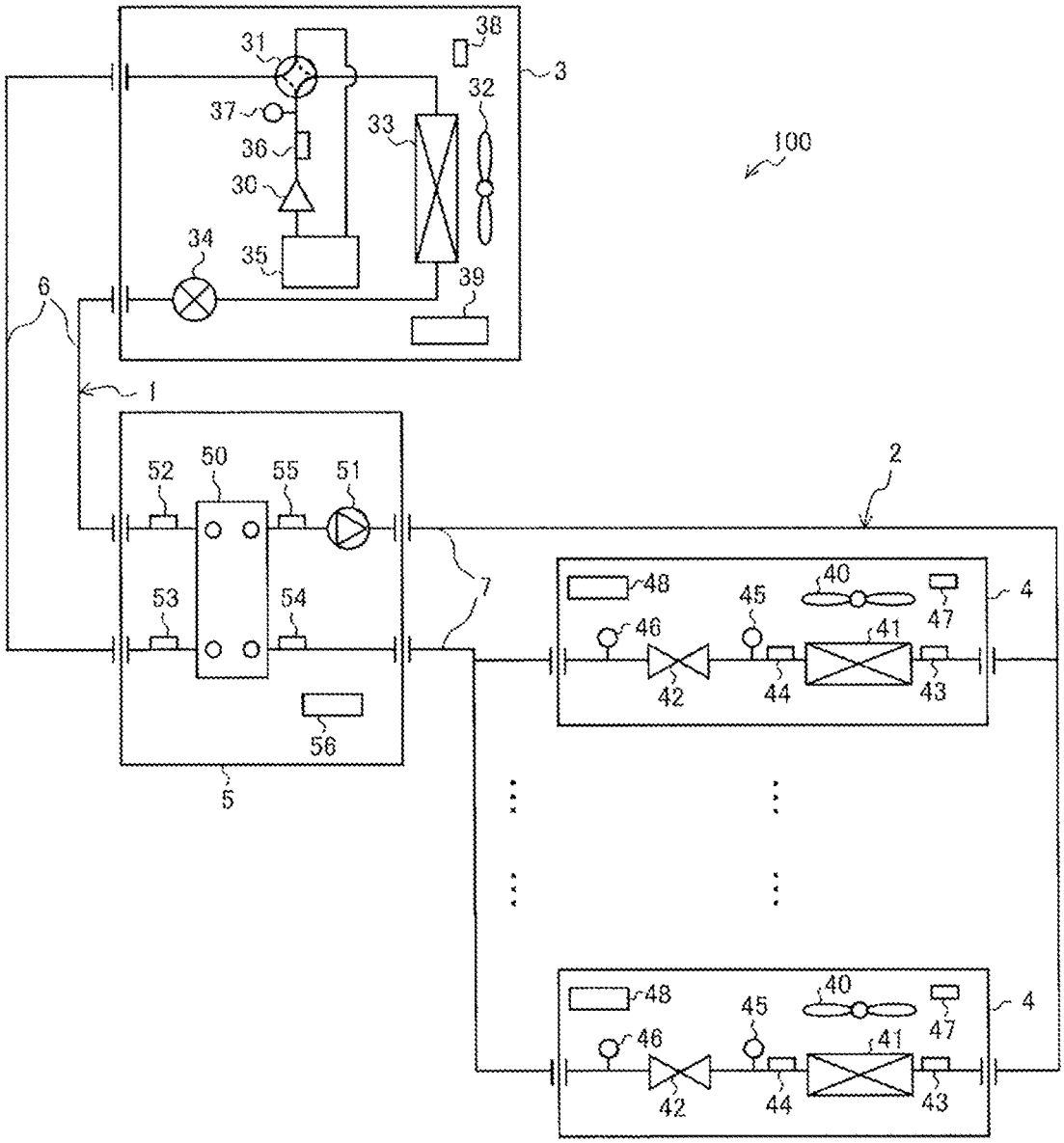
FIG. 2 is a diagram illustrating an exemplary configuration of the air-conditioning apparatus according to Embodiment.

FIG. 2 is a diagram illustrating an exemplary configuration of the air-conditioning apparatus according to Embodiment. The outdoor unit 3 includes, in a casing, a compressor 30, a flow switching device 31, a heat source side fan 32, a heat source side heat exchanger 33, an expansion device 34, and an accumulator 35. The accumulator 35, the compressor 30, the flow switching device 31, the heat source side heat exchanger 33, and the expansion device 34 are connected by the refrigerant pipe 6.

The compressor 30 sucks the refrigerant, compresses the refrigerant into a high-temperature and high-pressure state, and discharges the refrigerant. The compressor 30 may be, for example, a compressor whose capacity is adjustable. The flow switching device 31 is a device that switches between refrigerant passages for a cooling operation of the air-conditioning apparatus 100 and refrigerant passages for a heating operation of the air-conditioning apparatus 100. In FIG. 2, solid lines in the flow switching device 31 represent the refrigerant passages for the cooling operation, and broken lines represent the refrigerant passages for the heating operation. If the air-conditioning apparatus 100 performs only the cooling operation or the heating operation, the air-conditioning apparatus 100 may exclude the flow switching device 31.

The heat source side fan 32 directs outdoor air to the heat source side heat exchanger 33. The heat source side heat exchanger 33 exchanges heat between the refrigerant and the outdoor air supplied by the heat source side fan 32. The heat source side heat exchanger 33 operates as a condenser or a radiator in the cooling operation and causes the refrigerant to reject heat. The heat source side heat exchanger 33 operates as an evaporator in the heating operation and causes the refrigerant to receive heat. The air subjected to heat exchange in the heat source side heat exchanger 33 is sent to the outside by the heat source side fan 32.

The expansion device 34 includes a pressure-reducing valve or an expansion valve, and reduces the pressure of the refrigerant to expand the refrigerant. The expansion device 34 may include, for example, an electronic expansion device, and can adjust its opening degree to any extent so that, for example, the flow rate of the refrigerant can be regulated as intended. The expansion device 34 may be disposed in the intermediate unit 5 rather than the outdoor unit 3 or may be disposed in each of the outdoor unit 3 and the intermediate unit 5.

The accumulator 35 is located on a refrigerant suction side of the compressor 30 in the outdoor unit 3. The accumulator 35 accumulates an excess of the refrigerant that is generated due to, for example, the difference between the amount of refrigerant used in the heating operation and that in the cooling operation, or an excess of the refrigerant that is generated for a transition period during which an operation mode of the air-conditioning apparatus 100 is switched to another operation mode. The accumulator 35 does not need to be disposed in the outdoor unit 3.

Each of the indoor units 4 includes, in a casing, an indoor side fan 40, an indoor heat exchanger 41, and a flow control device 42. The indoor heat exchanger 41 and the flow control device 42 are connected by the heat medium pipe 7.

The indoor side fan 40 generates a current of air to direct indoor air in a room to the indoor heat exchanger 41 and return the air to the room. The indoor heat exchanger 41 includes fins and heat transfer tubes, through which the heat medium passes. The indoor heat exchanger 41 exchanges heat between the indoor air supplied by the indoor side fan 40 and the heat medium passing through the heat transfer tubes. At a temperature lower than that of the air, the heat medium passing through the heat transfer tubes cools the air. The cooled air is sent into the room, so that the room is air-conditioned by cooling. At a temperature higher than that of the air, the heat medium passing through the heat transfer tubes heats the air. The heated air is sent to the room, so that the room is air-conditioned by heating.

The flow control device 42 includes a two-way valve whose opening degree is adjustable. The opening degree of the flow control device 42 is adjusted to regulate a flow rate of the heat medium flowing through the indoor heat exchanger 41. Hereinafter, a state in which the opening degree of the flow control device 42 is not zero and in which the flow control device 42 permits the heat medium to flow therethrough may be referred to as an open state. In addition, a state in which the opening degree of the flow control device 42 is zero and in which the flow control device 42 does not permit the heat medium to flow therethrough may be referred to as a closed state or a fully closed state.

The opening degree of the flow control device 42 is adjusted in response to an instruction from an indoor controller 48, which will be described later. For example, the flow control device 42 regulates the flow rate of the heat medium to pass through the indoor heat exchanger 41 in response to an instruction from the indoor controller 48 that is based on a temperature of the heat medium flowing into the indoor heat exchanger 41 and a temperature of the heat medium leaving the indoor heat exchanger 41. This enables the indoor heat exchanger 41 to exchange an amount of heat that depends on a thermal load in the room.

Referring to FIG. 2, the flow control device 42 is disposed at the heat medium pipe 7 on a heat medium outlet side of the indoor heat exchanger 41. The flow control device 42 may be disposed at the heat medium pipe 7 on a heat medium inlet side of the indoor heat exchanger 41. The flow control device 42 located on either the heat medium outlet side or the heat medium inlet side of the indoor heat exchanger 41 can regulate the flow rate of the heat medium flowing out of the indoor unit 4 and the flow rate of the heat medium flowing into the indoor heat exchanger 41 because the heat medium is pressurized by a pump 51, which will be described later.

If the indoor heat exchanger 41 does not need to exchange heat, for example, when the air-conditioning apparatus 100 or the indoor unit 4 stops operating, or while the air-conditioning apparatus 100 or the indoor unit 4 is in a thermo-off state, the flow control device 42, which includes the valve, may be fully closed so that the heat medium does not flow into the indoor heat exchanger 41. In each of a case where the indoor unit 4 does not perform an air-conditioning operation and a case where the indoor unit 4 is in the thermo-off state, the flow control device 42 in Embodiment is in the fully closed state unless the flow control device 42 receives an instruction from the indoor controller 48.

The intermediate unit 5 includes an intermediate heat exchanger 50 and the pump 51. The intermediate heat exchanger 50 exchanges heat between the refrigerant and the heat medium. The intermediate heat exchanger 50 heats the heat medium in the heating operation of the air-conditioning apparatus 100. In this case, the intermediate heat exchanger 50 operates as a condenser or a radiator, and the refrigerant transfers heat to the heat medium. The intermediate heat exchanger 50 cools the heat medium in the cooling operation of the air-conditioning apparatus 100. In this case, the intermediate heat exchanger 50 operates as an evaporator, and the refrigerant receives heat from the heat medium.

The pump 51 sucks the heat medium leaving the intermediate heat exchanger 50, pressurizes the heat medium, and discharges the heat medium to the heat medium pipe 7. The heat medium is circulated through the heat medium circuit 2 under pressure applied by the pump 51. The pump 51 is an exemplary circulation device that circulates the heat medium though the heat medium circuit 2.

Actions of the air-conditioning apparatus 100 will now be described. First, an action of the air-conditioning apparatus 100 in the cooling operation will be described. The compressor 30 sucks the refrigerant, compresses the refrigerant into a high-temperature, high-pressure state, and discharges the refrigerant. The discharged refrigerant flows into the heat source side heat exchanger 33 via the flow switching device 31. The heat source side heat exchanger 33 exchanges heat between the incoming refrigerant and the air supplied by the heat source side fan 32, thus condensing and liquefying the refrigerant. The condensed and liquefied refrigerant passes through the expansion device 34. The expansion device 34 reduces the pressure of the refrigerant passing therethrough. The pressure-reduced refrigerant flows out of the outdoor unit 3, passes through the refrigerant pipe 6, and flows into the intermediate heat exchanger 50 in the intermediate unit 5. The intermediate heat exchanger 50 exchanges heat between the incoming refrigerant from the heat source side and the heat medium that has flowed into the intermediate heat exchanger 50 in the intermediate unit 5 after leaving the indoor units 4.

Heat exchange in the intermediate heat exchanger 50 causes the refrigerant to receive heat from the heat medium and evaporate, and causes the heat medium to transfer heat to the refrigerant and be cooled. The refrigerant leaving the intermediate heat exchanger 50 flows out of the intermediate unit 5, passes through the refrigerant pipe 6, and flows into the outdoor unit 3. In the outdoor unit 3, the incoming refrigerant again passes through the flow switching device 31 and is sucked into the compressor 30.

The heat medium leaving the intermediate heat exchanger 50 is pressurized by the pump 51, flows out of the intermediate unit 5, passes through the heat medium pipe 7, and flows into the indoor units 4. In each of the indoor units 4, the incoming heat medium flows into the indoor heat exchanger 41. The indoor heat exchanger 41 exchanges heat between the incoming heat medium and the air supplied by the indoor side fan 40. Heat exchange in the indoor heat exchanger 41 causes the heat medium to receive heat from the air, thus cooling the air. The air is sent to the room by the indoor side fan 40. The heat medium leaving the indoor heat exchanger 41 flows out of the indoor unit 4 via the flow control device 42 in the open state, passes through the heat medium pipe 7, and again flows into the intermediate heat exchanger 50 in the intermediate unit 5.

Next, an action of the air-conditioning apparatus 100 in the heating operation will be described. The compressor 30 sucks the refrigerant, compresses the refrigerant into a high-temperature and high-pressure state, and discharges the refrigerant. The discharged refrigerant flows out of the outdoor unit 3 via the flow switching device 31, passes through the refrigerant pipe 6, and flows into the intermediate heat exchanger 50 in the intermediate unit 5. The intermediate heat exchanger 50 exchanges heat between the refrigerant passing therethrough and the heat medium passing therethrough. Heat exchange in the intermediate heat exchanger 50 causes the refrigerant to transfer heat to the heat medium, condense, and liquefy. The heat medium receives heat from the refrigerant and is thus heated.

The refrigerant leaving the intermediate heat exchanger 50 flows out of the intermediate unit 5, passes through the refrigerant pipe 6, and flows into the outdoor unit 3. The refrigerant is reduced in pressure by the expansion device 34. After that, the refrigerant flows into the heat source side heat exchanger 33. The heat source side heat exchanger 33 exchanges heat between the incoming refrigerant and the air supplied by the heat source side fan 32, thus evaporating and gasifying the refrigerant. The evaporated and gasified refrigerant passes through the flow switching device 31 and is sucked into the compressor 30.

The heat medium leaving the intermediate heat exchanger 50 flows out of the intermediate unit 5, passes through the heat medium pipe 7, and flows into the indoor units 4. In each of the indoor units 4, the incoming heat medium exchanges heat with the air, supplied by the indoor side fan 40, in the indoor heat exchanger 41. This heat exchange causes the heat medium to transfer heat to the air, so that the air is heated. The air is sent to the room by the indoor side fan 40. The heat medium leaving the indoor heat exchanger 41 flows out of the indoor unit 4 via the flow control device 42 in the open state, passes through the heat medium pipe 7, and again flows into the intermediate heat exchanger 50 in the intermediate unit 5.

The air-conditioning apparatus 100 further includes various sensors each detecting a physical quantity and various controllers each performing control using a detected physical quantity in addition to the above-described components. Specifically, the outdoor unit 3 includes a discharge temperature sensor 36, a discharge pressure sensor 37, an outdoor temperature sensor 38, and an outdoor controller 39. The intermediate unit 5 includes a first refrigerant temperature sensor 52, a second refrigerant temperature sensor 53, a heat-medium inlet-side temperature sensor 54, a heat-medium outlet-side temperature sensor 55, and an intermediate controller 56. Each of the indoor units 4 includes an indoor inlet-side temperature sensor 43, an indoor outlet-side temperature sensor 44, an indoor inlet-side pressure sensor 45, an indoor outlet-side pressure sensor 46, an indoor temperature sensor 47, and the indoor controller 48.

The discharge temperature sensor 36 in the outdoor unit 3 is disposed at the refrigerant pipe 6 on a refrigerant discharge side of the compressor 30, and detects a temperature of the refrigerant discharged by the compressor 30. The discharge temperature sensor 36 outputs a discharge temperature detection signal representing the detected temperature of the refrigerant to the outdoor controller 39.

The discharge temperature sensor 36 in Embodiment includes a thermistor. Similarly, each of the outdoor temperature sensor 38, the first refrigerant temperature sensor 52, the second refrigerant temperature sensor 53, the heat-medium inlet-side temperature sensor 54, and the heat-medium outlet-side temperature sensor 55 in Embodiment includes a thermistor. Furthermore, each of the indoor inlet-side temperature sensor 43, the indoor outlet-side temperature sensor 44, and the indoor temperature sensor 47 in Embodiment includes a thermistor.

The discharge pressure sensor 37 is disposed at the refrigerant pipe 6 on the refrigerant discharge side of the compressor 30, and detects a pressure of the refrigerant discharged by the compressor 30. The discharge pressure sensor 37 outputs a discharge pressure detection signal representing the detected pressure of the refrigerant to the outdoor controller 39.

The outdoor temperature sensor 38 is disposed at a position where air flows into the heat source side heat exchanger 33 in the outdoor unit 3, and detects an outdoor temperature, which is an ambient temperature of the outdoor unit 3. The outdoor temperature sensor 38 outputs an outdoor temperature detection signal representing the detected outdoor temperature to the outdoor controller 39.

The outdoor controller 39 controls the components included in the outdoor unit 3, such as the compressor 30, the flow switching device 31, and the heat source side fan 32. The outdoor controller 39 will be described in detail later.

The first refrigerant temperature sensor 52 in the intermediate unit 5 is disposed at the refrigerant pipe 6 on a refrigerant inlet side of the intermediate heat exchanger 50 in the cooling operation. The second refrigerant temperature sensor 53 is disposed at the refrigerant pipe 6 on a refrigerant inlet side of the intermediate heat exchanger 50 in the heating operation. Each of the first refrigerant temperature sensor 52 and the second refrigerant temperature sensor 53 detects a temperature of the refrigerant flowing into the intermediate heat exchanger 50 or a temperature of the refrigerant leaving the intermediate heat exchanger 50. Each of the first refrigerant temperature sensor 52 and the second refrigerant temperature sensor 53 outputs a refrigerant temperature detection signal representing the detected temperature of the refrigerant to the intermediate controller 56.

The heat-medium inlet-side temperature sensor 54 is disposed at the heat medium pipe 7 on a heat medium inlet side of the intermediate heat exchanger 50, and detects a temperature of the heat medium flowing into the intermediate heat exchanger 50. The heat-medium inlet-side temperature sensor 54 outputs an inlet-side heat-medium temperature detection signal representing the detected temperature of the heat medium to the intermediate controller 56. The heat-medium outlet-side temperature sensor 55 is disposed at the heat medium pipe 7 on a heat medium outlet side of the intermediate heat exchanger 50, and detects a temperature of the heat medium leaving the intermediate heat exchanger 50. The heat-medium outlet-side temperature sensor 55 outputs an outlet-side heat-medium temperature detection signal representing the detected temperature of the heat medium to the intermediate controller 56.

The intermediate controller 56 controls, for example, the above-described pump 51. The intermediate controller 56 will be described in detail later.

The intermediate unit 5 may further include a sensor, such as a pressure sensor that detects the pressure of the heat medium or the refrigerant or a flow rate sensor that detects the flow rate of the heat medium or the refrigerant, in addition to the above-described components.

The indoor inlet-side temperature sensor 43 in each indoor unit 4 is disposed at the heat medium pipe 7 on the heat medium inlet side of the indoor heat exchanger 41, and detects a temperature of the heat medium flowing into the indoor heat exchanger 41. The indoor inlet-side temperature sensor 43 outputs an indoor inlet-side temperature detection signal representing the detected temperature of the heat medium to the indoor controller 48.

The indoor outlet-side temperature sensor 44 is disposed at the heat medium pipe 7 on the heat medium outlet side of the indoor heat exchanger 41, and detects a temperature of the heat medium leaving the indoor heat exchanger 41. The indoor outlet-side temperature sensor 44 outputs an indoor outlet-side temperature detection signal representing the detected temperature of the heat medium to the indoor controller 48.

The indoor inlet-side pressure sensor 45 is disposed at the heat medium pipe 7 on a heat medium inlet side of the flow control device 42, and detects a pressure of the heat medium flowing into the flow control device 42. The indoor inlet-side pressure sensor 45 outputs an indoor inlet-side pressure detection signal representing the detected pressure of the heat medium to the indoor controller 48.

The indoor outlet-side pressure sensor 46 is disposed at the heat medium pipe 7 on a heat medium outlet side of the flow control device 42, and detects a pressure of the heat medium leaving the flow control device 42. The indoor outlet-side pressure sensor 46 outputs an indoor outlet-side pressure detection signal representing the detected pressure of the heat medium to the indoor controller 48.

If a pressure sensor that detects the pressure of the heat medium circulating through the heat medium circuit 2 is included in a unit other than the indoor units 4, for example, the intermediate unit 5, each of the indoor units 4 may exclude at least one of the indoor inlet-side pressure sensor 45 or the indoor outlet-side pressure sensor 46. Furthermore, the indoor unit 4 may include a flow rate detection device that detects the flow rate of the heat medium instead of or in addition to at least one of the indoor inlet-side pressure sensor 45 or the indoor outlet-side pressure sensor 46.

The indoor temperature sensor 47 is located on an air inlet side of the indoor heat exchanger 41. The indoor temperature sensor 47 detects a suction temperature, which is the temperature of air directed into the indoor heat exchanger 41 due to a current of air generated by driving the indoor side fan 40. The suction temperature can be used as an estimated temperature of the air in the room, which is the air-conditioning target space. The indoor temperature sensor 47 outputs a suction temperature detection signal representing the suction temperature to the indoor controller 48.

The indoor controller 48 controls the components included in the indoor unit 4, such as the indoor side fan 40 and the flow control device 42. The indoor controller 48 calculates and obtains the amount of heat transferred from the heat medium to the air or the amount of heat transferred from the air to the heat medium through heat exchange in the indoor heat exchanger 41 by using detection results of the indoor inlet-side temperature sensor 43 and the indoor outlet-side temperature sensor 44.

The indoor unit 4 may further include a heat amount detection device capable of detecting the above-described amount of heat exchanged between the indoor air and the heat medium in addition to the above-described components. The indoor controller 48 may obtain detection information representing the detected amount of heat from the heat amount detection device.

The outdoor controller 39, the indoor controller 48, and the intermediate controller 56 can communicate with each other in a wired or wireless manner. Each of the outdoor controller 39, the indoor controller 48, and the intermediate controller 56 controls the components, serving as control targets, on the basis of physical quantities represented by the signals obtained from the above-described various sensors or in response to, for example, an instruction represented by a signal received from another controller. For example, the outdoor controller 39 and the intermediate controller 56 receive, for example, a setting instruction input to the indoor unit 4 via a remote control (not illustrated), from the indoor controller 48 and control the control target components on the basis of the setting instruction.

Each of the outdoor controller 39, the indoor controller 48, and the intermediate controller 56 can include a processor, such as a central processing unit (CPU) or a micro processing unit (MPU), a memory, such as a read-only memory (ROM) or a random access memory (RAM), a communication interface circuit, and an input/output interface circuit. The outdoor controller 39, the indoor controller 48, and the intermediate controller 56 each have a communication function, which can be implemented by the communication interface circuit. The outdoor controller 39, the indoor controller 48, and the intermediate controller 56 each have a function of obtaining detection signals from the various sensors, and the function can be implemented by the input/output interface circuit. The outdoor controller 39, the indoor controller 48, and the intermediate controller 56 each have a control function, which can be implemented by causing the processor to execute an application, such as a device driver, stored in the memory and to transmit a control signal for a control target via the input/output interface circuit to the control target. The outdoor controller 39, the indoor controller 48, and the intermediate controller 56 each have, for example, a calculation function or a determination function, which can be implemented by causing the processor to execute various programs stored in the memory. The whole or part of each of the outdoor controller 39, the indoor controller 48, and the intermediate controller 56 may be implemented by dedicated hardware. For example, each of the outdoor controller 39, the indoor controller 48, and the intermediate controller 56 may include a programmable logic controller (PLC), such as a field-programmable gate array (FPGA). The control function of each of the outdoor controller 39, the indoor controller 48, and the intermediate controller 56 may be implemented using a driver circuit.

In Embodiment, the indoor controller 48 transmits a signal representing the obtained heat amount to the intermediate controller 56. The indoor controller 48 transmits a signal representing a physical quantity detected by any sensor in the indoor unit 4, such as the indoor inlet-side temperature sensor 43 or the indoor outlet-side temperature sensor 44, to the intermediate controller 56. The indoor controller 48 may transmit data on, for example, features of any device included in the indoor unit 4, for example, a heat exchange capacity of the indoor heat exchanger 41, to the intermediate controller 56.

Typically, for example, a low thermal load or a small number of indoor units in operation leads to a smaller number of heat medium passages. This results in an increase in pressure loss in a heat medium circuit.

As the pressure loss increases, the flow rate of a heat medium to an intermediate unit decreases. Thus, the heat medium may fail to be supplied to an intermediate heat exchanger at a sufficient flow rate. If a sufficient flow rate of the heat medium to the intermediate unit is not achieved in the cooling operation, the heat medium in the intermediate heat exchanger may be excessively cooled by refrigerant cooled in an outdoor unit and thus freeze.

To increase the flow rate of the heat medium, for example, controlling a pump can further pressurize the heat medium. However, such control may cause the following problems. Pressurization by the pump under conditions where the number of heat medium passages is small may increase a flow velocity of the heat medium. A high flow velocity of the heat medium through a heat medium pipe can cause an oxide film protecting the heat medium pipe to separate from the pipe. Such separation may cause erosion-corrosion, or corrosion of metal forming the heat medium pipe. Erosion-corrosion tends to occur, particularly at high temperatures of the heat medium. To prevent erosion-corrosion, the flow velocity of the heat medium through the heat medium pipe needs to be reduced. A flow velocity at which erosion-corrosion occurs varies depending on the type of metal, serving as a material for the heat medium pipe. For example, in a case where the material is copper, the flow velocity of the heat medium needs to be less than or equal to 1.5 [m/s] to prevent erosion-corrosion. Erosion-corrosion may also occur in heat medium passages of devices in the heat medium circuit.

Some known air-conditioning apparatuses include outdoor units having a function of preventing freezing described above. However, such an outdoor unit repeatedly performs control based on this function and control for the cooling operation, so that such an air-conditioning apparatus may operate unstably.

Figure 3:
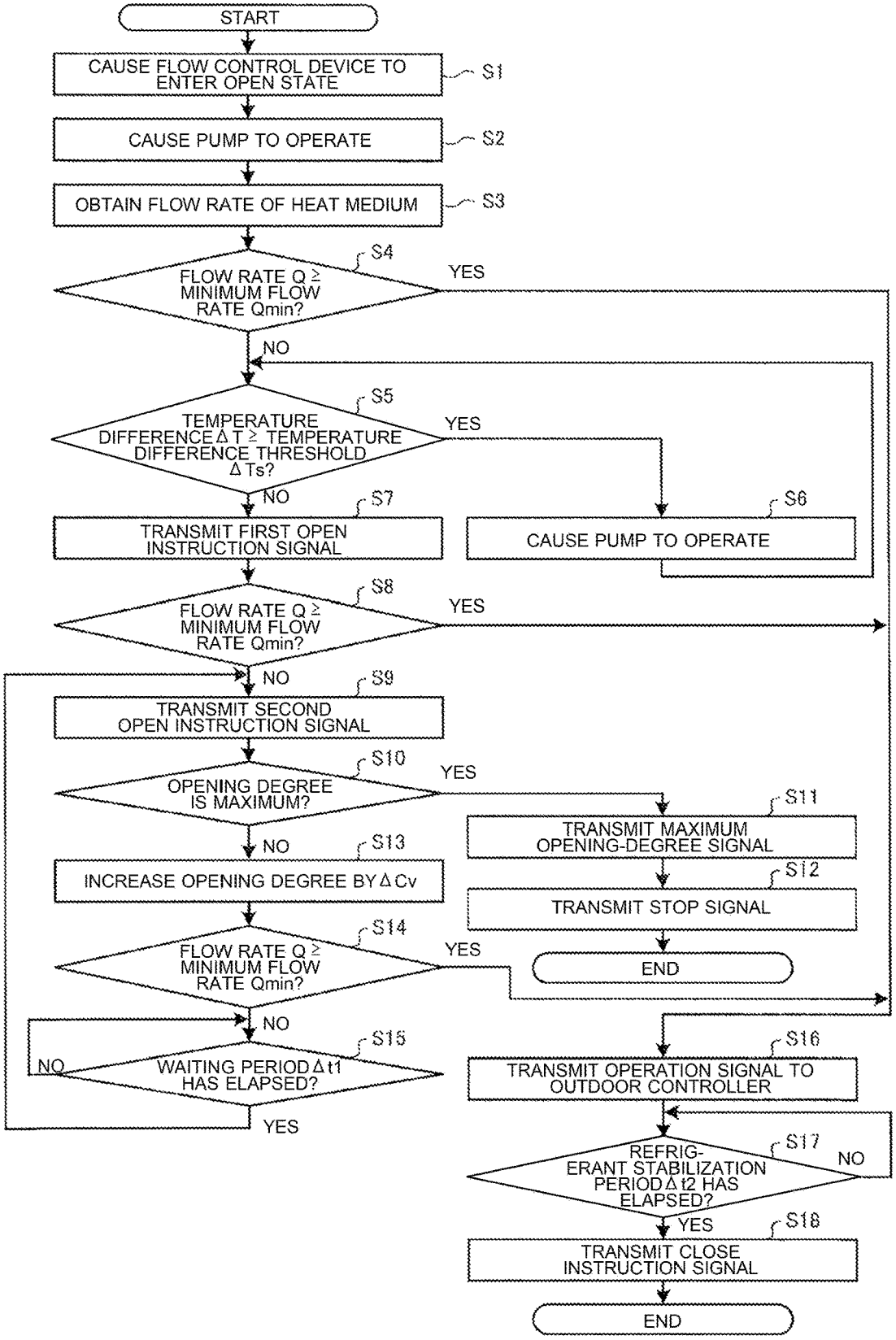
FIG. 3 is a flowchart illustrating a freezing preventing process by the air-conditioning apparatus according to Embodiment.

The air-conditioning apparatus 100 according to Embodiment is intended to inhibit freezing of the heat medium while achieving a stable operation. A process, by the air-conditioning apparatus 100 according to Embodiment, for inhibiting freezing of the heat medium will now be described in detail. FIG. 3 is a flowchart illustrating a freezing preventing process by the air-conditioning apparatus according to Embodiment. For example, it is assumed that a subset of the multiple indoor units 4 performs the cooling operation. In other words, the subset of the indoor units 4 is activated and performs the cooling operation, and the other indoor units 4 perform neither the cooling operation nor the heating operation. In the following description, the subset of the indoor units 4 performing the cooling operation may be referred to as an "indoor unit 4 to operate" or an "indoor unit 4 in operation", and the indoor unit 4 that performs neither the cooling operation nor the heating operation may be referred to as an "indoor unit 4 in a non-operation state".

In step S1, the indoor controller 48 of the indoor unit 4 to operate causes the flow control device 42 to enter the open state for circulation of the heat medium in response to a cooling-operation start instruction input through, for example, the remote control. Furthermore, the indoor controller 48 causes the indoor side fan 40 to operate and transmits an operation signal representing an instruction to start the cooling operation to the intermediate controller 56. In step S2, the intermediate controller 56 causes the pump 51 to operate in response to receiving the operation signal.

In step S3, the intermediate controller 56 obtains a flow rate of the heat medium flowing through the intermediate heat exchanger 50. The flow rate may be obtained based on, for example, a pressure difference between pressures detected by the indoor inlet-side pressure sensor 45 and the indoor outlet-side pressure sensor 46 in the indoor unit 4 and a Cv value by using the following equation, for example.

$$Q=45.58\times Cv\times(\Delta P/G)^{1/2}$$

In the equation, Q is the flow rate [US gal/min] of the heat medium, Cv is the Cv value [−] of the heat medium passage, ΔP is the pressure difference [kPa], and G is the specific gravity [−] of the heat medium. The Cv value is defined as a value representing the flow rate [US gal/min] of water at a temperature of approximately 15.5 degrees C. that flows through the flow control device 42 having a specific opening degree at a pressure difference of 6.895 [kPa] per unit time. The Cv value is a value relating to the opening degree of the flow control device 42, and the opening degree changes depending on the above-described heat amount. Therefore, the Cv value is a value relating to the heat amount. The heat amount is the amount of heat received from or transferred to the air by the heat medium through heat exchange in the indoor heat exchanger 41, and is calculated based on detection results of the indoor inlet-side temperature sensor 43 and the indoor outlet-side temperature sensor 44 by the indoor controller 48.

The intermediate controller 56 calculates the Cv value by using the heat amount received from the indoor controller 48. Furthermore, the intermediate controller 56 calculates the above-described pressure difference ΔP from the detection results of the indoor inlet-side pressure sensor 45 and the indoor outlet-side pressure sensor 46 received from the indoor controller 48. The intermediate controller 56 may obtain, instead of the above-described heat amount, the detection results of the indoor inlet-side temperature sensor 43 and the indoor outlet-side temperature sensor 44 from the indoor controller 48 and calculate the Cv value by using the detection results. Alternatively, the intermediate controller 56 may obtain a signal representing the opening degree of the flow control device 42 from the indoor controller 48 and calculate the Cv value by using the opening degree.

Before step S3, for example, in step S1, the intermediate controller 56 receives signals representing, for example, detection results of the above-described various sensors from the respective indoor controllers 48 of the multiple indoor units 4 for calculation of the pressure difference ΔP and the Cv value. The intermediate controller 56 calculates the flow rate Q of the heat medium flowing from each indoor unit 4 to the intermediate heat exchanger 50 by using, for example, the above-described equation. The intermediate controller 56 then calculates, as a total flow rate of the heat medium to the intermediate heat exchanger 50, the sum of the flow rates Q from the respective indoor units 4. In the following description, the total flow rate of the heat medium from the multiple indoor units 4 to the intermediate heat exchanger 50 will also be denoted by Q.

The flow rate Q of the heat medium may be obtained by the flow rate sensor disposed in the intermediate unit 5. Alternatively, the flow rate Q may be obtained based on a rotation speed of a motor for the pump 51 and a commanded value to the motor from the intermediate controller 56.

In step S4, the intermediate controller 56 determines whether the flow rate Q of the heat medium obtained in step S3 is greater than or equal to a minimum flow rate Qmin. The minimum flow rate Qmin is a minimum flow rate of the heat medium that s required to inhibit freezing of the heat medium, for example, upon activation of the outdoor unit 3. The minimum flow rate Qmin, which has been determined based on freezing resistance of the intermediate heat exchanger 50 and a reduced temperature of the refrigerant upon activation of the outdoor unit 3, is stored in the intermediate controller 56. The freezing resistance of the intermediate heat exchanger 50 has been determined based on, for example, the performance or specifications of the intermediate heat exchanger 50. The reduced temperature, which is affected by the temperature of outdoor air, of the refrigerant upon activation of the outdoor unit 3 has been determined by testing.

If the flow rate Q is greater than or equal to the minimum flow rate Qmin (YES in step S4), the intermediate controller 56 causes the process to proceed to step S16. If the flow rate Q is less than the minimum flow rate Qmin (NO in step S4), the intermediate controller 56 determines, in step S5, whether a temperature difference ΔT between a set temperature Tm in the indoor unit 4 in operation and a heat medium temperature Tw is greater than or equal to a temperature difference threshold ΔTs. The temperature difference ΔT, which is based on the heat medium temperature Tw, is a temperature obtained by subtracting the heat medium temperature Tw from the set temperature Tm. The set temperature Tm is a temperature set through, for example, the remote control, upon activation of the indoor unit 4 to operate, and is contained in information represented by the operation signal received by the intermediate controller 56 in step S1. The heat medium temperature Tw is a temperature detected by the indoor inlet-side temperature sensor 43, the indoor outlet-side temperature sensor 44, the heat-medium inlet-side temperature sensor 54, or the heat-medium outlet-side temperature sensor 55. In a case where the heat medium temperature Tw to be used in step S5 is a temperature detected by the indoor inlet-side temperature sensor 43 or the indoor outlet-side temperature sensor 44, the intermediate controller 56 receives the temperature Tw from the indoor controller 48 in step S5. The temperature difference threshold ΔTs is a minimum temperature difference between the set temperature Tm and the heat medium temperature Tw that is required for the indoor unit 4 to cool the air to the set temperature Tm, and has been determined in advance by testing, for example. The temperature difference threshold ΔTs may be flexibly set depending on, for example, an installation environment of the air-conditioning apparatus 100.

If the temperature difference ΔT is greater than or equal to the temperature difference threshold ΔTs (YES in step S5), the intermediate controller 56 causes, in step S6, the pump 51 to operate without transmitting an operation signal to the outdoor controller 39. Thus, the outdoor unit 3 does not operate, but the heat medium circulates through the heat medium circuit 2 and flows into the indoor unit 4 in operation. The indoor unit 4 causes the heat medium to exchange heat with air, thus cooling the air. After processing in step S6, the intermediate controller 56 returns the process to step S5. If a combination of processing in step S5 and processing in step S6 is repeated a predetermined number of times, the intermediate controller 56 may cause the process to proceed to step S7 or step S16.

If the above-described temperature difference ΔT between the heat medium temperature Tw and the set temperature Tm is less than the temperature difference threshold ΔTs (NO in step S5), the intermediate controller 56 causes the process in the intermediate unit 5 to proceed to step S7. In step S7, the intermediate controller 56 transmits a first open instruction signal, which represents an instruction to cause the flow control device 42 to enter the open state, to the indoor controller 48 of the indoor unit 4 in the non-operation state. In response to receiving the first open instruction signal, the indoor controller 48 causes the flow control device 42 to enter the open state, thus establishing a passage for the heat medium. This leads to a reduction in flow resistance of the heat medium, resulting in lower pressure loss. This increases the flow rate Q of the heat medium to the intermediate heat exchanger 50.

In a case where there are indoor units 4 as transmission destinations of the first open instruction signal, the intermediate controller 56 in Embodiment transmits the following first open instruction signal to each of these indoor units 4. The first open instruction signal is intended to adjust the opening degree of the flow control device 42 so that the ratio of the capacities of these indoor units 4 is equal to the ratio of the Cv values of the flow control devices 42 of these indoor units 4. If a temperature detected by the indoor temperature sensor 47 in the indoor unit 4 in the non-operation state is greater than or equal to an indoor temperature threshold Tas, the indoor controller 48 may cause the flow control device 42 to remain closed. The indoor temperature threshold Tas is stored in the indoor controller 48 in advance. The indoor temperature threshold Tas is an upper limit indoor temperature at which no drip of condensation occurs for a predetermined period of time while the heat medium at a temperature lower than a minimum settable temperature Tmmin of the indoor unit 4 by the temperature difference threshold ΔTs is flowing through the indoor unit 4 at a rated flow rate through the indoor unit 4. The rated flow rate through the indoor unit 4 is determined based on the capacity of the indoor unit 4.

In step S8, the intermediate controller 56 determines whether the flow rate Q of the heat medium flowing into the intermediate heat exchanger 50 is greater than or equal to the minimum flow rate Qmin in response to the flow control device 42 of the indoor unit 4 in the non-operation state being in the open state. If the flow rate Q is calculated using, for example, a signal representing a pressure and a signal representing a heat amount or a temperature from the indoor controller 48 as described above, the intermediate controller 56 can receive these signals from the indoor controller 48 after the flow control device 42 enters the open state.

If the flow rate Q of the heat medium flowing into the intermediate heat exchanger 50 is greater than or equal to the minimum flow rate Qmin (YES in step S8), the intermediate controller 56 causes the process to proceed to step S16.

If the flow rate Q of the heat medium flowing into the intermediate heat exchanger 50 is less than the minimum flow rate Qmin (NO in step S8), the intermediate controller 56 transmits a second open instruction signal to the indoor controller 48 of the indoor unit 4 in the non-operation state in step S9. The second open instruction signal is a signal representing an instruction to increase the opening degree of the flow control device 42 by ΔCv, which is a predetermined minute opening degree. The first and second open instruction signals are exemplary open instruction signals each representing an instruction to increase the opening degree of the flow control device 42.

In response to receiving the second open instruction signal, the indoor controller 48 determines, in step S10, whether the opening degree of the flow control device 42 is at a maximum. If the opening degree of the flow control device 42 is at a maximum (YES in step S10), the indoor controller 48 transmits a maximum opening-degree signal, which represents that the opening degree of the flow control device 42 has already reached a maximum value, to the intermediate controller 56 in step S11.

In the case where the flow rate Q of the heat medium flowing into the intermediate heat exchanger 50 is less than the minimum flow rate Qmin irrespective of the maximum opening degree of the flow control device 42, it is presumed that water failure has occurred in the heat medium circuit 2. For this reason, in response to receiving the maximum opening-degree signal, the intermediate controller 56 transmits a stop signal representing an instruction to stop the cooling operation to the outdoor controller 39 and the indoor controller 48 in step S12. In response to receiving the stop signal, the outdoor controller 39 stops the operation of the outdoor unit 3. Similarly, in response to receiving the stop signal, the indoor controller 48 stops the operation of the indoor unit 4. The intermediate controller 56 may omit transmission of the stop signal to the indoor controller 48 serving as a transmission source of the maximum opening-degree signal. In this case, the indoor controller 48 stops the operation of the indoor unit 4 on the basis of a determination result in step S10. After processing in step S12, the air-conditioning apparatus 100 terminates the freezing preventing process.

If the indoor controller 48 determines in step S10 that the opening degree of the flow control device 42 is not at a maximum (NO in step S10), the indoor controller 48 increases the opening degree of the flow control device 42 by ΔCv in step S13. If a temperature detected b the indoor temperature sensor 47 in the indoor unit 4 that has received the second open instruction signal is greater than or equal to the indoor temperature threshold Tas, the indoor controller 48 may cause the flow control device 42 to remain closed.

In step S14, the intermediate controller 56 determines whether the flow rate Q of the heat medium flowing into the intermediate heat exchanger 50 is greater than or equal to the minimum flow rate Qmin. If the flow rate Q of the heat medium flowing into the intermediate heat exchanger 50 is greater than or equal to the minimum flow rate Qmin (YES in step S14), the intermediate controller 56 causes the process to proceed to step S16.

If the flow rate Q of the heat medium flowing into the intermediate heat exchanger 50 is less than the minimum flow rate Qmin (NO in step S14), the intermediate controller 56 determines, in step S15, whether a predetermined waiting period Δt1 has elapsed since transmission of the second open instruction signal in step S9. If the waiting period Δt1 has not elapsed (NO in step S15), the intermediate controller 56 causes the process to stay in step S15. If the waiting period Δt1 has elapsed (YES in step S15), the intermediate controller 56 returns the process to step S9.

In step S16, the intermediate controller 56 transmits an operation signal representing an instruction to start the cooling operation to the outdoor controller 39. In response to receiving the operation signal, the outdoor controller 39 causes the compressor 30 to operate.

In step S17, the intermediate controller 56 determines whether a refrigerant stabilization period Δt2 has elapsed since transmission of the operation signal to the outdoor controller 39. The refrigerant stabilization period Δt2 is the time required for the temperature of the refrigerant to stabilize, for example, an initial speed increasing period upon activation of the compressor 30 under control of the outdoor controller 39. The term "speed increasing period" refers to the time taken by the rotation speed of the compressor 30 to become constant after start of operation of the compressor 30. The refrigerant stabilization period is determined based on, for example, details of control by the outdoor controller 39. If the refrigerant stabilization period Δt2 has not elapsed (NO in step S17), the intermediate controller 56 causes the process to stay in step S17.

If the refrigerant stabilization period Δt2 has elapsed (YES in step S17), the intermediate controller 56 transmits a close instruction signal representing an instruction to close the flow control device 42 to the indoor controller 48 of the indoor unit 4 in the non-operation state in step S18. Thus, the operation switches to a normal cooling operation that is performed by the outdoor unit 3, the intermediate unit 5, and the indoor unit 4 in operation. The air-conditioning apparatus 100 then terminates the freezing preventing process.

Instead of processing in steps S9 to S13, the air-conditioning apparatus 100 may perform the following processing. The intermediate controller 56 receives information on the opening degree of the flow control device 42 from the indoor controller 48 of the indoor unit 4 in the non-operation state at timing of, for example, step S7, step S8, or step S13 before the process returns to step S9 The intermediate controller 56 then determines whether the opening degree of the flow control device 42 is at a maximum. If the opening degree is at a maximum, the intermediate controller 56 transmits a stop signal to each of the outdoor controller 39 and the indoor controller 48. If the opening degree is not at a maximum, the intermediate controller 56 transmits an open instruction signal to the indoor controller 48. The indoor controller 48 that has received the open instruction signal increases the opening degree by ΔCv.

Advantages of the air-conditioning apparatus 100 according to Embodiment will be described below. The air-conditioning apparatus 100 according to Embodiment includes the refrigerant circuit 1, through which the refrigerant circulates, and the heat medium circuit 2, through which the heat medium circulates. The air-conditioning apparatus 100 includes the outdoor unit 3, the multiple indoor units 4, and the intermediate unit 5. The outdoor unit 3 is located in the refrigerant circuit 1 and exchanges heat between the refrigerant and the outdoor air. The multiple indoor units 4 are located in the heat medium circuit 2 and exchange heat between the heat medium and the indoor air to condition the indoor air. The intermediate unit 5 is located in the refrigerant circuit 1 and the heat medium circuit 2, exchanges heat between the refrigerant and the heat medium, and sends the heat medium subjected to heat exchange with the refrigerant to the multiple indoor units 4. Each of the multiple indoor units 4 includes the flow control device 42 and the indoor controller 48. The flow control device 42 regulates the flow rate Q of the heat medium leaving the indoor unit 4. The indoor controller 48 adjusts the opening degree of the flow control device 42. The intermediate unit 5 includes the intermediate heat exchanger 50, the circulation device, and the intermediate controller 56. The intermediate heat exchanger 50 exchanges heat between the refrigerant and the heat medium. The circulation device causes the heat medium to circulate between the intermediate heat exchanger 50 and each of the multiple indoor units 4. The intermediate controller 56 controls the circulation device. When at least one of the multiple indoor units 4 starts operating, the intermediate controller 56 determines whether the flow rate Q of the heat medium flowing into the intermediate heat exchanger 50 from the multiple indoor units 4 is greater than or equal to the predetermined minimum flow rate Qmin. In response to determining that the flow rate Q is less than the minimum flow rate Qmin, the intermediate controller 56 transmits an open instruction signal representing an instruction to increase the opening degree of the flow control device 42 to the indoor controller 48 of the indoor unit 4 that is in the non-operation state of the multiple indoor units 4, When receiving the open instruction signal, the indoor controller 48 increases the opening degree of the flow control device 42 in response to the open instruction signal.

In the above-described configuration, the intermediate controller 56 determines whether the flow rate Q of the heat medium flowing into the intermediate heat exchanger 50 is greater than or equal to the minimum flow rate Qmin. In response to determining that the flow rate Q is less than the minimum flow rate Qmin, the intermediate controller 56 transmits an open instruction signal, representing an instruction to increase the opening degree, to the indoor controller 48 of the indoor unit 4 in the non-operation state. In response to receiving the open instruction signal, the indoor controller 48 increases the opening degree of the flow control device 42. Thus, the heat medium flows into the intermediate heat exchanger 50 not only from the indoor unit 4 in operation but also from the indoor unit 4 in the non-operation state. This leads to a reduction in flow resistance of the heat medium, resulting in lower pressure loss. This increases the flow rate Q of the heat medium to the intermediate heat exchanger 50. Thus, the air-conditioning apparatus 100 can inhibit freezing of the heat medium in the intermediate heat exchanger 50. In addition, the air-conditioning apparatus 100 according to Embodiment achieves an increase in the flow rate Q of the heat medium by increasing the opening degree of the flow control device 42 of the indoor unit 4 in the non-operation state. This eliminates the need for a bypass to ensure that the flow rate Q is sufficient. This results in a reduction in cost of the air-conditioning apparatus 100.

After transmitting the open instruction signal to the indoor controller 48 of the indoor unit 4 in the non-operation state, the intermediate controller 56 in Embodiment determines whether the flow rate Q is greater than or equal to the minimum flow rate Qmin. In response to determining that the flow rate Q is less than the minimum flow rate Qmin, the intermediate controller 56 again transmits the open instruction signal to the indoor controller 48 of the indoor unit 4 in the non-operation state. Thus, the air-conditioning apparatus 100 can increase the opening degree of the flow control device 42 in the indoor unit 4 in the non-operation state until the flow rate Q of the heat medium is greater than or equal to the minimum flow rate Qmin. Therefore, the flow rate Q of the heat medium to the intermediate heat exchanger 50 increases until reaching or exceeding the minimum flow rate Qmin. Thus, the air-conditioning apparatus 100 can reliably inhibit freezing of the heat medium in the intermediate heat exchanger 50.

In response to determining that the flow rate Q is less than the minimum flow rate Qmin when at least one of the multiple indoor units 4 starts operating, the intermediate controller 56 in Embodiment transmits a first open instruction signal to the indoor controller 48 of the indoor unit 4 in the non-operation state. The first open instruction signal, which represents an instruction to cause the flow control device 42 to enter the open state, is one of open instruction signals. The indoor unit 4 in the non-operation state, serving as a transmission destination of the first open instruction signal, includes the flow control device 42 in the closed state. When receiving the first open instruction signal, the indoor controller 48 causes the flow control device 42 to enter the open state in response to the first open instruction signal. Thus, in the case where the flow rate of the heat medium is less than the minimum flow rate Qmin, the air-conditioning apparatus 100 allows the flow control device 42 in the closed state to enter the open state. This leads to a reduction in flow resistance of the heat medium, resulting in lower pressure loss. This increases the flow rate Q of the heat medium to the intermediate heat exchanger 50. Thus, the air-conditioning apparatus 100 can inhibit freezing of the heat medium in the intermediate heat exchanger 50.

In the case where there are two or more indoor units 4 that are in the non-operation state and that each include the flow control device 42 in the closed state, the intermediate controller 56 in Embodiment transmits the following first open instruction signal to each of the two or more indoor units 4 in the non-operation state. The first open instruction signal represents an instruction to adjust the opening degree of the flow control device 42 to cause the ratio of the capacities of the two or more indoor units 4 in the non-operation state to be equal to the ratio of the Cv values of the flow control devices 42 of the two or more indoor units 4 in the non-operation state. Thus, the heat medium required depending on the capacity flows through each indoor unit 4.

After transmitting the first open instruction signal to the indoor controller 48 of the indoor unit 4 in the non-operation state, the intermediate controller 56 in Embodiment determines whether the flow rate Q is greater than or equal to the minimum flow rate Qmin. In response to determining that the flow rate Q is less than the minimum flow rate Qmin, the intermediate controller 56 transmits a second open instruction signal, which represents an instruction to increase the opening degree of the flow control device 42 by the predetermined opening degree ΔCv, to the indoor controller 48 of the indoor unit 4 in the non-operation state. The second open instruction signal is the other one of the open instruction signals. Thus, in the case where the flow rate Q of the heat medium is less than the minimum flow rate Qmin, the air-conditioning apparatus 100 can further increase the opening degree of the flow control device 42 of the indoor unit 4 in the non-operation state. Therefore, the air-conditioning apparatus 100 can further increase the flow rate Q of the heat medium to the intermediate heat exchanger 50. Thus, the air-conditioning apparatus 100 can inhibit freezing of the heat medium in the intermediate heat exchanger 50.

After transmitting the second open instruction signal to the indoor controller 48 of the indoor unit 4 in the non-operation state, the intermediate controller 56 in Embodiment determines whether the flow rate Q is greater than or equal to the minimum flow rate Qmin. In response to determining that the flow rate Q is less than the minimum flow rate Qmin, the intermediate controller 56 again transmits the second open instruction signal to the indoor controller 48 of the indoor unit 4 in the non-operation state. This enables the air-conditioning apparatus 100 to gradually increase the opening degree of the flow control device 42 of the indoor unit 4 in the non-operation state until the flow rate Q of the heat medium reaches or exceeds the minimum flow rate Qmin. Therefore, the air-conditioning apparatus 100 allows the flow rate Q of the heat medium to the intermediate heat exchanger 50 to reach or exceed the minimum flow rate Qmin. Thus, the air-conditioning apparatus 100 can reliably inhibit freezing of the heat medium in the intermediate heat exchanger 50.

The minimum flow rate Qmin in Embodiment is determined using a reduced temperature of the refrigerant upon activation of the outdoor unit 3 and information on the performance or specifications of the intermediate heat exchanger 50. Thus, the minimum flow rate Qmin, which is required to inhibit freezing of the heat medium, relative to the refrigerant in the intermediate heat exchanger 50 is accurately determined. The air-conditioning apparatus 100 determines whether the flow rate Q of the heat medium to the intermediate heat exchanger 50 is greater than or equal to the accurately determined minimum flow rate Qmin, and increases the opening degree of the flow control device 42 of the indoor unit 4 in the non-operation state in response to determining that the flow rate Q is less than the minimum flow rate Qmin. Thus, the air-conditioning apparatus 100 ensures that the flow rate Q is sufficient to prevent the heat medium from freezing, thus inhibiting freezing of the heat medium.

The outdoor unit 3 in Embodiment starts operating in response to receiving an operation signal, representing an instruction to operate, from the intermediate controller 56. The intermediate controller 56 transmits no operation signal to the outdoor unit 3 in response to determining that the flow rate Q is less than the minimum flow rate Qmin. This inhibits cooling of the refrigerant in the outdoor unit 3 and sending of the refrigerant to the intermediate heat exchanger 50 as long as the flow rate Q of the heat medium is less than the minimum flow rate Qmin. Therefore, the air-conditioning apparatus 100 can inhibit freezing of the heat medium due to the refrigerant in the intermediate heat exchanger 50. If the outdoor unit 3 has a function of preventing freezing, the air-conditioning apparatus 100 can reduce repetition of processing for the cooling operation and processing based on this function by the outdoor unit 3. Thus, the air-conditioning apparatus 100 can operate stably.

The outdoor unit 3 in Embodiment includes the compressor 30 and the outdoor controller 39. The compressor 30 compresses the refrigerant. The outdoor controller 39 communicates with the intermediate controller 56 and causes the compressor 30 to operate in response to an operation signal from the intermediate controller 56. The intermediate controller 56 transmits no operation signal to the outdoor controller 39 in response to determining that the flow rate Q of the heat medium is less than the minimum flow rate Qmin. This inhibits cooling of the refrigerant in the outdoor unit 3 and sending of the refrigerant to the intermediate heat exchanger 50 as long as the flow rate Q of the heat medium is less than the minimum flow rate Qmin. Thus, the air-conditioning apparatus 100 can inhibit freezing of the heat medium due to the refrigerant in the intermediate heat exchanger 50. If the outdoor unit 3 has the function of preventing freezing, the air-conditioning apparatus 100 can reduce repetition of processing for the cooling operation and processing based on this function by the outdoor unit 3. Thus, the air-conditioning apparatus 100 can operate stably.

The intermediate controller 56 in Embodiment transmits an operation signal to the outdoor unit 3 in response to determining that the flow rate Q of the heat medium is greater than or equal to the minimum flow rate Qmin. When the predetermined refrigerant stabilization period Δt2, which is the time required for the temperature of the refrigerant to stabilize, has elapsed since transmission of the operation signal, the intermediate controller 56 transmits a close instruction signal, which represents an instruction to cause the flow control device 42 to enter the closed state, to the indoor controller 48 of the indoor unit 4 in the non-operation state. Thus, the outdoor unit 3 starts operating as long as the flow rate Q of the heat medium relative to the refrigerant is sufficient to keep the heat medium from freezing. Since the intermediate controller 56 transmits the close instruction signal to the indoor unit 4 in the non-operation state after a lapse of the refrigerant stabilization period Δt2 from transmission of the operation signal, the heat medium does not flow from the indoor unit 4 in the non-operation state into the intermediate heat exchanger 50 after stabilization of the temperature of the refrigerant. Therefore, an excess of the heat medium does not flow through the indoor unit 4 in the non-operation state, thus reducing a change in temperature of the heat medium through heat exchange in the indoor unit 4 in the non-operation state. This reduces or eliminates the likelihood that the heat medium having an increased temperature may flow into the intermediate heat exchanger 50 from the indoor unit 4 in the non-operation state in the cooling operation. Thus, the outdoor unit 3 does not need to perform a process of further cooling the refrigerant to cool the heat medium in the intermediate heat exchanger 50. Therefore, the air-conditioning apparatus 100 can inhibit freezing of the heat medium and achieve energy saving.

The intermediate controller 56 in Embodiment transmits an operation signal to the outdoor controller 39 in response to determining that the flow rate Q of the heat medium is greater than or equal to the minimum flow rate Qmin. After a lapse of the predetermined refrigerant stabilization period Δt2, which is the time required for the temperature of the refrigerant to stabilize, from transmission of the operation signal, the intermediate controller 56 transmits a close instruction signal, which represents an instruction to cause the flow control device 42 to enter the closed state, to the indoor controller 48 of the indoor unit 4 in the non-operation state. The refrigerant stabilization period Δt2 is determined based on the speed increasing period taken by the rotation speed of the compressor 30 to become constant after start of operation of the compressor 30. Thus, the outdoor unit 3 starts operating as long as the flow rate Q of the heat medium relative to the refrigerant is sufficient to keep the heat medium from freezing. The intermediate controller 56 transmits the close instruction signal to the indoor unit 4 in the non-operation state after a lapse of the refrigerant stabilization period Δt2, which is the time required for the rotation speed of the compressor 30 to become constant, from transmission of the operation signal. Thus, the heat medium does not flow into the intermediate heat exchanger 50 from the indoor unit 4 in the non-operation state under conditions where the temperature of the refrigerant is stable and the heat medium does not freeze. Therefore, an excess of the heat medium does not flow through the indoor unit 4 in the non-operation state. Thus, the air-conditioning apparatus 100 can inhibit freezing of the heat medium and reduce wasteful processing.

The intermediate unit 5 in Embodiment further incudes at least one temperature sensor of the heat-medium inlet-side temperature sensor 54 or the heat-medium outlet-side temperature sensor 55. The heat-medium inlet-side temperature sensor 54 detects the temperature of the heat medium flowing into the intermediate heat exchanger 50. The heat-medium outlet-side temperature sensor 55 detects the temperature of the heat medium leaving the intermediate heat exchanger 50. In response to determining that the flow rate Q of the heat medium is less than the minimum flow rate Qmin, the intermediate controller 56 determines whether the temperature difference ΔT between the set temperature Tm, which is set in the indoor unit 4 in operation of the multiple indoor units 4, and the temperature Tw detected by the at least one temperature sensor is greater than or equal to the temperature difference threshold ΔTs. The intermediate controller 56 transmits no open instruction signal to the indoor controller 48 of the indoor unit 4 in the non-operation state while the temperature difference ΔT is greater than or equal to the temperature difference threshold ΔTs. The outdoor unit 3 does not operate in the case where the flow rate of the heat medium is less than the minimum flow rate Qmin. Thus, in the case where the temperature Tw of the heat medium is low enough to provide the cooling operation, the air-conditioning apparatus 100 conditions air without causing the outdoor unit 3 to operate and causing the heat medium to flow through the indoor unit 4 in the non-operation state. Thus, while inhibiting freezing of the heat medium due to the refrigerant, the air-conditioning apparatus 100 enables the indoor unit 4 in operation to appropriately condition the air. The air-conditioning apparatus 100 can reduce wasteful processing since the heat medium is not caused to flow through the indoor unit 4 in the non-operation state.

Each of the multiple indoor units 4 in Embodiment further includes at least one temperature sensor of the indoor inlet-side temperature sensor 43 or the indoor outlet-side temperature sensor 44. The indoor inlet-side temperature sensor 43 detects the temperature of the heat medium flowing into the indoor heat exchanger 41. The indoor outlet-side temperature sensor 44 detects the temperature of the heat medium leaving the indoor heat exchanger 41. In response to determining that the flow rate Q of the heat medium is less than the minimum flow rate Qmin the intermediate controller 56 receives a signal representing the temperature Tw detected by the at least one temperature sensor from the indoor controller 48, and determines whether the temperature difference ΔT between the temperature Tw detected by the at least one temperature sensor and the set temperature Tm set in the indoor unit 4 in operation of the multiple indoor units 4 is greater than or equal to the temperature difference threshold ΔTs. The intermediate controller 56 transmits no open instruction signal to the indoor controller 48 of the indoor unit 4 in the non-operation state while the temperature difference ΔT is greater than or equal to the temperature difference threshold ΔTs. The outdoor unit 3 does not operate in the case where the flow rate of the heat medium is less than the minimum flow rate Qmin. Thus, in the case where the temperature of the heat medium is low enough to provide the cooling operation, the air-conditioning apparatus 100 conditions air without causing the outdoor unit 3 to operate and causing the heat medium to flow through the indoor unit 4 in the non-operation state. Therefore, while inhibiting freezing of the heat medium due to the refrigerant, the air-conditioning apparatus 100 enables the indoor unit 4 in operation to appropriately condition the air. The air-conditioning apparatus 100 can reduce wasteful processing since the heat medium is not caused to flow through the indoor unit 4 in the non-operation state.

Each of the multiple indoor units 4 in Embodiment further includes the indoor inlet-side pressure sensor 45, the indoor outlet-side pressure sensor 46, the indoor inlet-side temperature sensor 43, and the indoor outlet-side temperature sensor 44. The indoor inlet-side pressure sensor 45 detects the pressure of the heat medium flowing into the flow control device 42. The indoor outlet-side pressure sensor 46 detects the pressure of the heat medium leaving the flow control device 42. The indoor inlet-side temperature sensor 43 detects the temperature of the heat medium flowing into the indoor heat exchanger 41. The indoor outlet-side temperature sensor 44 detects the temperature of the heat medium leaving the indoor heat exchanger 41.

The intermediate controller 56 receives detection results of the indoor inlet-side pressure sensor 45, the indoor outlet-side pressure sensor 46, the indoor inlet-side temperature sensor 43, and the indoor outlet-side temperature sensor 44 from the indoor controller 48 of each of the multiple indoor units 4. The intermediate controller 56 calculates the flow rate Q of the heat medium using the detection results. Thus, the intermediate controller 56 can accurately obtain the flow rate Q of the heat medium and appropriately perform the freezing preventing process.

Each of the multiple indoor units 4 in Embodiment further includes the indoor inlet-side pressure sensor 45, the indoor outlet-side pressure sensor 46, the indoor inlet-side temperature sensor 43, and the indoor outlet-side temperature sensor 44. The indoor inlet-side pressure sensor 45 detects the pressure of the heat medium flowing into the flow control device 42. The indoor outlet-side pressure sensor 46 detects the pressure of the heat medium leaving the flow control device 42. The indoor inlet-side temperature sensor 43 detects the temperature of the heat medium flowing into the indoor heat exchanger 41. The indoor outlet-side temperature sensor 44 detects the temperature of the heat medium leaving the indoor heat exchanger 41. The indoor controller 48 calculates the amount of heat received or rejected by the heat medium in the indoor heat exchanger 41 by using the temperature detected by the indoor inlet-side temperature sensor 43 and the temperature detected by the indoor outlet-side temperature sensor 44. The indoor controller 48 transmits the amount of heat and detection results of the indoor inlet-side pressure sensor 45 and the indoor outlet-side pressure sensor 46 to the intermediate controller 56. The intermediate controller 56 calculates the flow rate Q of the heat medium by using the amount of heat and the detection results received from each of the multiple indoor units 4. Thus, the intermediate controller 56 can accurately obtain the flow rate Q of the heat medium and appropriately perform the freezing preventing process.

REFERENCE SIGNS LIST

1: refrigerant circuit, 2: heat medium circuit, 3: outdoor unit, 4: indoor unit, 5: intermediate unit, 6: refrigerant pipe, 7: heat medium pipe, 30: compressor, 31: flow switching device, 32: heat source side fan, 33: heat source side heat exchanger, 34: expansion device, 35: accumulator, 36: discharge temperature sensor, 37: discharge pressure sensor, 38: outdoor temperature sensor, 39: outdoor controller, 40: indoor side fan, 41: indoor heat exchanger, 42: flow control device, 43: indoor inlet-side temperature sensor, 44: indoor outlet-side temperature sensor, 45: indoor inlet-side pressure sensor, 46: indoor outlet-side pressure sensor, 47: indoor temperature sensor, 48: indoor controller, 50: intermediate heat exchanger, 51: pump, 52: first refrigerant temperature sensor, 53: second refrigerant temperature sensor, 54: heat-medium inlet-side temperature sensor, 55: heat-medium outlet-side temperature sensor, 56: intermediate controller, 100: air-conditioning apparatus, Q: flow rate, Qmin: minimum flow rate, Tas: indoor temperature threshold, Tm: set temperature, Tmmin: minimum settable temperature, Tw: temperature, ΔCv: minute opening degree, ΔP: pressure difference, ΔT: temperature difference, ΔTs: temperature difference threshold, Δt1: waiting period, Δt2: refrigerant stabilization period

The invention claimed is:

1. An air-conditioning apparatus comprising:

a refrigerant circuit through which refrigerant circulates;

a heat medium circuit through which a heat medium circulates;

an outdoor unit located in the refrigerant circuit and configured to exchange heat between the refrigerant and outdoor air;

a plurality of indoor units located in the heat medium circuit and configured to exchange heat between the heat medium and indoor air to condition the indoor air; and an intermediate unit located in the refrigerant circuit and the heat medium circuit and configured to exchange heat between the refrigerant and the heat medium and send the heat medium subjected to heat exchange with the refrigerant to the plurality of indoor units, each of the plurality of indoor units including a flow control device configured to regulate a flow rate of the heat medium leaving a corresponding one of the plurality of indoor units, and an indoor controller configured to adjust an opening degree of the flow control device, the intermediate unit including an intermediate heat exchanger configured to exchange heat between the refrigerant and the heat medium, a circulation device configured to circulate the heat medium between the intermediate heat exchanger and each of the plurality of indoor units, and an intermediate controller configured to control the circulation device, wherein the intermediate controller is configured to, when at least one indoor unit of the plurality of indoor units starts operating, determine whether a flow rate of the heat medium flowing into the intermediate heat exchanger from the plurality of indoor units is greater than or equal to a predetermined minimum flow rate, and in response to determining that the flow rate is less than the minimum flow rate, transmit an open instruction signal to the indoor controller of the indoor unit that is in a non-operation state of the plurality of indoor units, the open instruction signal representing an instruction to increase the opening degree of the flow control device, and wherein the indoor controller is configured to, when receiving the open instruction signal, increase the opening degree of the flow control device in response to the open instruction signal.

2. The air-conditioning apparatus of claim 1, wherein the intermediate controller is configured to, after transmitting the open instruction signal to the indoor controller of the indoor unit in the non-operation state, determine whether the flow rate is greater than or equal to the minimum flow rate, and in response to determining that the flow rate is less than the minimum flow rate, again transmit the open instruction signal to the indoor controller of the indoor unit in the non-operation state.

3. The air-conditioning apparatus of claim 1, wherein the intermediate controller is configured to, in response to determining that the flow rate is less than the minimum flow rate when at least one indoor unit of the plurality of indoor units starts operating, transmit a first open instruction signal to the indoor controller of the indoor unit that is in the non-operation state and that includes the flow control device in a closed state, the first open instruction signal being one type of the open instruction signal and representing an instruction to cause the flow control device to enter an open state, and wherein the indoor controller is configured to, when receiving the first open instruction signal, cause the flow control device to enter the open state in response to the first open instruction signal.

4. The air-conditioning apparatus of claim 3, wherein the intermediate controller is configured to, in a case where the plurality of indoor units include two or more indoor units being in the non-operation state and including the flow control device in the closed state, transmit the first open instruction signal to the indoor controller of each of the two or more indoor units in the non-operation state, the first open instruction signal representing an instruction to adjust the opening degree of the flow control device to cause a ratio of capacities of the two or more indoor units in the non-operation state to be equal to a ratio of Cv values of the flow control devices of the two or more indoor units in the non-operation state.

5. The air-conditioning apparatus of claim 3, wherein the intermediate controller is configured to, after transmitting the first open instruction signal to the indoor controller of the indoor unit in the non-operation state, determine whether the flow rate is greater than or equal to the minimum flow rate, and in response to determining that the flow rate is less than the minimum flow rate, transmit a second open instruction signal to the indoor controller of the indoor unit in the non-operation state, the second open instruction signal being an other type of the open instruction signal and representing an instruction to increase the opening degree of the flow control device by a predetermined opening degree.

6. The air-conditioning apparatus of claim 5, wherein the intermediate controller is configured to, after transmitting the second open instruction signal to the indoor controller of the indoor unit in the non-operation state, determine whether the flow rate is greater than or equal to the minimum flow rate, and in response to determining that the flow rate is less than the minimum flow rate, again transmit the second open instruction signal to the indoor controller of the indoor unit in the non-operation state.

7. The air-conditioning apparatus of claim 1, wherein the minimum flow rate is determined using a reduced temperature of the refrigerant upon activation of the outdoor unit and information on performance or specifications of the intermediate heat exchanger.

8. The air-conditioning apparatus claim 1, wherein the outdoor unit starts operating in response to receiving an operation signal from the intermediate controller, the operation signal representing an instruction to operate, and wherein the intermediate controller is configured to transmit no operation signal to the outdoor unit in response to determining that the flow rate is less than the minimum flow rate.

9. The air-conditioning apparatus of claim 8, wherein the outdoor unit includes a compressor configured to compress the refrigerant, and an outdoor controller configured to communicate with the intermediate controller and cause the compressor to operate in response to the operation signal from the intermediate controller, and wherein the intermediate controller is configured to transmit no operation signal to the outdoor controller in response to determining that the flow rate is less than the minimum flow rate.

10. The air-conditioning apparatus of claim 8, wherein the intermediate controller is configured to transmit the operation signal to the outdoor unit in response to determining that the flow rate is greater than or equal to the minimum flow rate, and after a lapse of a predetermined refrigerant stabilization period, which is a time required for a temperature of the refrigerant to stabilize, from transmission of the operation signal, transmit a close instruction signal to the indoor controller of the indoor unit in the non-operation state, the close instruction signal representing an instruction to cause the flow control device to enter a closed state.

11. The air-conditioning apparatus of claim 9, wherein the intermediate controller is configured to transmit the operation signal to the outdoor controller in response to determining that the flow rate is greater than or equal to the minimum flow rate, and after a lapse of a predetermined refrigerant stabilization period, which is a time required for a temperature of the refrigerant to stabilize, from transmission of the operation signal, transmit a close instruction signal to the indoor controller of the indoor unit in the non-operation state, the close instruction signal representing an instruction to cause the flow control device to enter a closed state, and wherein the refrigerant stabilization period is determined based on a speed increasing period taken by a rotation speed of the compressor to become constant after start of operation of the compressor.

12. The air-conditioning apparatus of claim 8, wherein the intermediate unit further includes at least one temperature sensor of a heat-medium inlet-side temperature sensor configured to detect a temperature of the heat medium flowing into the intermediate heat exchanger or a heat-medium outlet-side temperature sensor configured to detect a temperature of the heat medium leaving the intermediate heat exchanger, and wherein the intermediate controller is configured to, in response to determining that the flow rate is less than the minimum flow rate, determine whether a temperature difference between the temperature detected by the at least one temperature sensor and a set temperature set in the indoor unit in operation of the plurality of indoor units is greater than or equal to a temperature difference threshold, and while the temperature difference is greater than or equal to the temperature difference threshold, transmit no open instruction signal to the indoor controller of the indoor unit in the non-operation state.

13. The air-conditioning apparatus of claim 8, wherein each of the plurality of indoor units further includes an indoor heat exchanger configured to exchange heat between the heat medium and the indoor air, and at least one temperature sensor of an indoor inlet-side temperature sensor configured to detect a temperature of the heat medium flowing into the indoor heat exchanger or an indoor outlet-side temperature sensor configured to detect a temperature of the heat medium leaving the indoor heat exchanger, and wherein the intermediate controller is configured to, in response to determining that the flow rate is less than the minimum flow rate, receive a signal representing the temperature detected by the at least one temperature sensor, determine whether a temperature difference between the temperature detected by the at least one temperature sensor and a set temperature set in the indoor unit in operation of the plurality of indoor units is greater than or equal to a temperature difference threshold, and while the temperature difference is greater than or equal to the temperature difference threshold, transmit no open instruction signal to the indoor controller of the indoor unit in the non-operation state.

14. The air-conditioning apparatus of claim 1, wherein each of the plurality of indoor units further includes an indoor heat exchanger configured to exchange heat between the heat medium and the indoor air, an indoor inlet-side pressure sensor configured to detect a pressure of the heat medium flowing into the flow control device, an indoor outlet-side pressure sensor configured to detect a pressure of the heat medium leaving the flow control device, an indoor inlet-side temperature sensor configured to detect a temperature of the heat medium flowing into the indoor heat exchanger, and an indoor outlet-side temperature sensor configured to detect a temperature of the heat medium leaving the indoor heat exchanger, and wherein the intermediate controller is configured to receive detection results of the indoor inlet-side pressure sensor, the indoor outlet-side pressure sensor, the indoor inlet-side temperature sensor, and the indoor outlet-side temperature sensor from the indoor controller of each of the plurality of indoor units, and calculate the flow rate using the detection results.

15. The air-conditioning apparatus of claim 1, wherein each of the plurality of indoor units further includes an indoor heat exchanger configured to exchange heat between the heat medium and the indoor air, an indoor inlet-side pressure sensor configured to detect a pressure of the heat medium flowing into the flow control device, an indoor outlet-side pressure sensor configured to detect a pressure of the heat medium leaving the flow control device, an indoor inlet-side temperature sensor configured to detect a temperature of the heat medium flowing into the indoor heat exchanger, and an indoor outlet-side temperature sensor configured to detect a temperature of the heat medium leaving the indoor heat exchanger, wherein the indoor controller is configured to calculate an amount of heat received or rejected by the heat medium in the indoor heat exchanger by using the temperature detected by the indoor inlet-side temperature sensor and the temperature detected by the indoor outlet-side temperature sensor, and transmit the amount of heat and detection results of the indoor inlet-side pressure sensor and the indoor outlet-side pressure sensor to the intermediate controller, and wherein the intermediate controller is configured to calculate the flow rate by using the amount of heat and the detection results received from each of the plurality of indoor units.

* * * * *